US012624609B2

(12) United States Patent
Spitz et al.

(10) Patent No.: US 12,624,609 B2
(45) Date of Patent: May 12, 2026

(54) WELLHEAD SYSTEM AND METHOD OF OPERATING A WELLHEAD SYSTEM

(71) Applicant: OneSubsea AS, Lysaker (NO)

(72) Inventors: Stuart Spitz, Granada (ES); Adne Oestebroet, Bergen (NO); Sigve Angell Arnoey, Strusshamn (NO)

(73) Assignee: ONESUBSEA AS, Lysaker (NO)

( * ) Notice: Subject to any disclaimer, the term of this patent is extended or adjusted under 35 U.S.C. 154(b) by 0 days.

(21) Appl. No.: 18/744,712

(22) Filed: Jun. 17, 2024

(65) Prior Publication Data

US 2024/0426187 A1 Dec. 26, 2024

(30) Foreign Application Priority Data

Jun. 15, 2023 (GB) ..... 2308950

(51) Int. Cl.
*E21B 33/04* (2006.01)

(52) U.S. Cl.
CPC ..... *E21B 33/0415* (2013.01)

(58) Field of Classification Search
CPC ... E21B 33/0415; E21B 2200/03; E21B 33/04
See application file for complete search history.

(56) References Cited

U.S. PATENT DOCUMENTS

| | | | | |
|---|---|---|---|---|
| 6,581,691 | B1 | 6/2003 | Jennings | |
| 2010/0243261 | A1 | 9/2010 | Fern et al. | |
| 2014/0054044 | A1* | 2/2014 | Nellessen, Jr. | E21B 23/01 166/341 |
| 2020/0217165 | A1 | 7/2020 | Robottom et al. | |
| 2024/0003212 | A1 | 1/2024 | Spitz et al. | |

FOREIGN PATENT DOCUMENTS

| | | | | |
|---|---|---|---|---|
| EP | 2 053 195 | | 4/2009 | |
| GB | 2448262 | A * | 10/2008 | E21B 41/00 |
| GB | 2598183 | A | 2/2022 | |
| WO | WO 2020/146187 | A1 | 7/2020 | |
| WO | WO 2022/103272 | A1 | 5/2022 | |

* cited by examiner

*Primary Examiner* — James G Sayre
(74) *Attorney, Agent, or Firm* — Kyle R. Miiller

(57) ABSTRACT

A wellhead system includes a wellhead assembly and a landing assembly. The wellhead assembly is secured to a top of a borehole and has an interior surface enclosing a main passage. The landing assembly incudes a tubing hanger and an orientation control assembly. The landing assembly is lowered into the main passage to land the tubing hanger in the wellhead assembly. The orientation control assembly includes an orientation engagement assembly, an actuator system which moves the orientation engagement assembly between a retracted configuration and an engaged configuration where orientation engagement assembly engages with the interior surface of the wellhead assembly, a motor, and a drive part which engages with the orientation engagement assembly and, when the orientation engagement assembly is in the engaged configuration, to be driven by the motor and to rotate the tubing hanger relative to the wellhead assembly about a longitudinal axis of the landing assembly.

20 Claims, 8 Drawing Sheets

(a) (b)

WELLHEAD SYSTEM AND METHOD OF OPERATING A WELLHEAD SYSTEM

CROSS REFERENCE TO PRIOR APPLICATIONS

Priority is claimed to Great Britain Patent Application GB 2308950.1, filed Jun. 15, 2023. The entire disclosure of said application is incorporated by reference herein.

FIELD

The present invention relates to a wellhead system, in particular, but not exclusively to, a wellhead system including an orientation system for verifying the orientation of a tubing hanger relative to a wellhead, and a method of operating a wellhead system.

BACKGROUND

A wellhead system typically comprises a wellhead housing mounted at the upper end of a wellbore, and a tubing hanger which is secured to the wellhead housing. The tubing hanger supports a long tubing string (known as production tubing) which extends down into the wellbore and which provides a conduit for the flow of formation fluid out of the wellbore. The tubing hanger may be supported by a tubing spool which is mounted on top of the wellhead, or directly in the wellhead housing.

For a subsea wellhead, during the completion of the wellhead system, a blowout preventer (BOP) stack is mounted on the wellhead housing or, where a tubing spool is used, on the tubing spool, and a riser extends upwards from the BOP stack to a surface rig or vessel. The tubing hanger and associated production tubing is installed by securing a tubing hanger running tool to the tubing hanger, and using a landing string to lower the tubing hanger running tool etc. down the riser towards the wellhead, and land the tubing hanger in the desired position in the tubing spool/wellhead housing. The tubing hanger running tool can then be disconnected from the tubing hanger, and the landing string and tubing hanger running tool lifted out of the riser. The well is then prepared for completion by temporarily plugging the tubing hanger/production tubing, and removing the riser and BOP. A Christmas tree is them mounted on top of the tubing spool/wellhead housing, and the Christmas tree connected, via a tie-in arrangement, to production flow lines which carry the formation fluids flowing out of the wellbore.

In order to provide that the tie-in connections between the Christmas tree and the production flowlines are properly made up, it is important to land the Christmas tree so that it is oriented in a predetermined orientation relative to the wellhead housing and associated external structures such as a permanent guide base or template. If the Christmas tree is rotated about the longitudinal axis of the wellhead housing by even a few degrees from the desired orientation, a proper make-up of the tie-in connectors may be impossible.

Tubing hangers often provide conduits for communication between topside and the space in the wellhead below the tubing hanger, for example, for communication with or operation of sensors or equipment in the wellbore. These could be conduits for fluid flow, or comprise connections for the transmission of electrical or optical signals. Stab connectors or the like are typically provided at the upper end of the tubing hanger to provide for the connection to these conduits/connections, and these mate with corresponding connectors provided on the Christmas tree when the Christmas tree is landed on the wellhead. Because of these connections between the Christmas tree and the tubing hanger, the orientation of the Christmas tree is set by the orientation of the tubing hanger relative to the wellhead housing. It is therefore critical that when the tubing hanger is landed in the wellhead it is correctly oriented relative to the wellhead in order to provide that the orientation of the Christmas tree is correct when it is eventually landed.

Any misalignment of the tubing hanger may not become apparent until after the well is completed, and the riser and BOP removed, and a dedicated measurement tool is landed on the tubing hanger, and tested. To remedy the situation at this point, it is necessary to reinstall the BOP and riser, and to pull and reinstall the tubing hanger, a process which is enormously time consuming and expensive.

It will be appreciated that when the wellhead is located in deep water, the landing string can be very long, and there can be a significant twisting of the landing string as the tubing hanger running tool and tubing hanger are lowered down the riser. As such, knowledge of the orientation of the tubing hanger running tool/tubing hanger when it was first lowered into the riser does not assist in providing a sufficiently accurate knowledge of the orientation of the tubing hanger running tool once it has been lowered down the riser and is approaching the wellhead landing shoulder.

Providing a mechanical orientation system in which a formation such as a pin or key, which is mounted on a part secured relative to the wellhead housing (typically in the BOP stack), interacts with an helical groove or ridge arranged around a part secured relative to the tubing hanger, in order to rotate the tubing hanger into the required orientation relative to the wellhead, has previously been described.

An example of such mechanical orientation systems is described in WO 2020/146187. In the system described therein, a hanger orientation device, having a helical profile, is mounted between the landing string and the tubing hanger running tool. A helical ridge is provided on the radially outward facing surface of the hanger orientation device, and this engages with a pin which is mounted on the wellhead to rotate the tubing hanger to the desired orientation.

WO 2022/103272 describes a wellhead system comprising a landing assembly and wellhead assembly, the landing assembly being provided with an orientation sensor assembly which is configured to measure the angular rotation of the landing string about its longitudinal axis. The orientation sensor assembly may be used to provide that the landing assembly is correctly orientated when it is landed in the wellhead assembly.

SUMMARY

An aspect of the present application is to provide a new wellhead system which is configured so that the ease of landing a landing assembly in a wellhead assembly at a precise orientation is further improved.

In an embodiment, the present invention provides a wellhead system which includes a wellhead assembly and a landing assembly. The wellhead assembly is generally tubular and is configured to be secured to a top of a borehole. The wellhead assembly comprises a main passage having a longitudinal axis, and an interior surface which encloses the main passage. The landing assembly comprises a tubing hanger, a longitudinal axis, and an orientation control assembly. The landing assembly is configured to be lowered into the main passage of the wellhead assembly to land the tubing hanger in the wellhead assembly. The orientation control assembly comprises an orientation engagement assembly, an actuator system which is configured to move the orientation engagement assembly between a retracted configuration and an engaged configuration in which orientation engagement assembly engages with the interior surface of the wellhead assembly, a motor, and a drive part which is configured to engage with the orientation engagement assembly and, when the orientation engagement assembly is in the engaged configuration, to be driven by the motor and to rotate the tubing hanger relative to the wellhead assembly about the longitudinal axis of the landing assembly.

BRIEF DESCRIPTION OF THE DRAWINGS

The present invention is described in greater detail below on the basis of embodiments and of the drawings in which.

DETAILED DESCRIPTION

Figure 1:
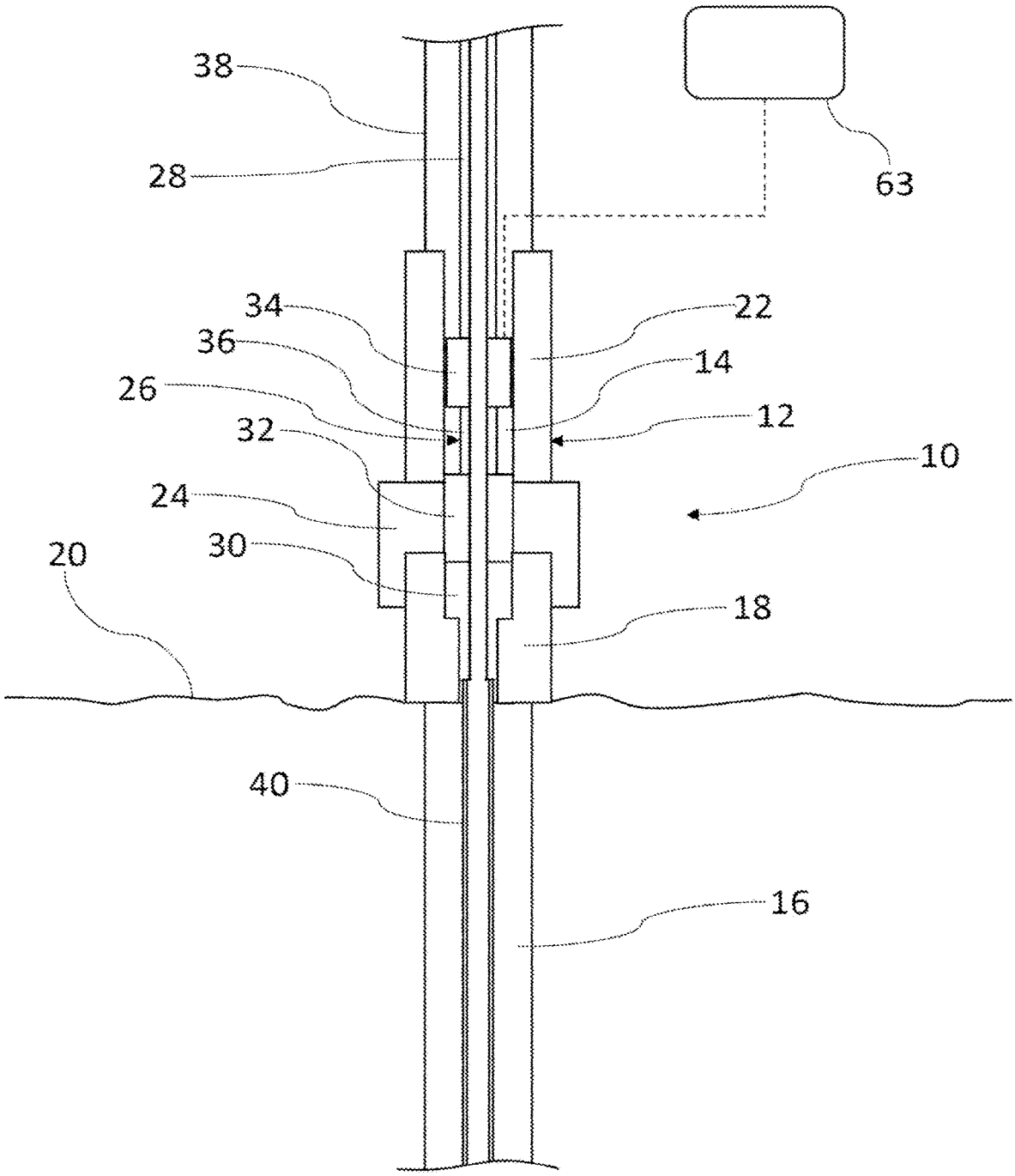
FIG. 1 is a schematic illustration of a wellhead system according to the present invention secured to the top of a subsea wellbore.

A first aspect of the present invention provides a wellhead system comprising a generally tubular wellhead assembly with a main passage having a longitudinal axis, the wellhead assembly being configured to be secured to the top of a borehole, the wellhead assembly having an interior surface which encloses the main passage, the wellhead system further comprising a landing assembly comprising a tubing hanger, the landing assembly being configured to be lowered into the main passage of the wellhead assembly to land the tubing hanger in the wellhead assembly, the landing assembly having a longitudinal axis and further comprising an orientation control assembly which comprises an orientation engagement assembly, and an actuator system which is configured to move the orientation engagement assembly between a retracted configuration and an engaged configuration in which it engages with the interior surface of the wellhead assembly, the orientation control assembly further comprising a motor and a drive part which is configured to engage with the orientation engagement assembly and, when driven by the motor, to rotate the landing assembly about its longitudinal axis.

The orientation engagement assembly and drive part may be configured, when the orientation engagement assembly is in its engaged configuration and also engaged with the drive part, to prevent rotation of the landing assembly relative to the wellhead assembly in the absence of operation of the motor.

The motor may comprise a hydraulic or electric motor.

The drive part may be connected to the motor so that operation of the motor rotates the drive part. In this case, operation of the motor may rotate the drive part about an axis of rotation which is parallel to the longitudinal axis of the landing assembly.

The drive part may comprise a plurality of radially outwardly extending teeth, and the orientation engagement assembly may comprise an orientation engagement part having a plurality radially inwardly extending teeth which are configured to mesh with the teeth of the drive part.

The drive part may comprise a pinion gear.

The orientation control assembly may comprise a body, and the orientation engagement assembly may be annular and extend around the entire circumference of the body.

The orientation control assembly may comprise a body, and the orientation engagement assembly may comprise a locking part which is movable radially outwardly of the body to engage with the interior surface of the wellhead assembly.

The orientation engagement assembly may comprise a plurality of locking parts which are movable radially outwardly of the body to engage with the interior surface of the wellhead assembly.

The actuator system may be driven by the motor and drive part to move the or each locking part from its retracted configuration to its engaged configuration, the drive part rotating the landing assembly about its longitudinal axis once the or each locking part is in its engaged configuration.

The actuator system may be moved by the supply of pressurized fluid to the actuator system to move the or each locking part from the retracted configuration to the engaged configuration.

The orientation control assembly advantageously further comprises an orientation sensor assembly which is configured to measure the orientation of the tubing hanger.

The system may further comprise a controller which is connected to the motor and which is configured to control the operation of the motor, and which is connected to the orientation sensor assembly and configured to receive a signal from the orientation sensor assembly indicative of the orientation of the tubing hanger.

The controller may be further configured to use the signal from the orientation sensor assembly to determine whether the orientation of the tubing hanger deviates from a desired orientation, and to operate the motor to rotate the tubing hanger about its longitudinal axis to bring the tubing hanger to the desired orientation.

The wellhead system may further comprise a soft landing device which is operable to allow a downward movement of the tubing hanger in the wellhead through a travel distance after initial engagement of the tubing hanger with a landing surface provided in the wellhead from an initial landing position to a final landing position. The orientation engagement assembly and drive part may in this case be configured to remain engaged as the tubing hanger moves with the landing surface as the landing surface moves from its initial landing position to its final landing position.

The drive part may comprise a plurality of radially outwardly pointing teeth, and the orientation engagement assembly may comprise an orientation engagement part having a plurality of radially inwardly pointing teeth which are configured to mesh with the teeth of the drive part, the teeth of the drive part each comprising a radially outwardly pointing ridge which extends generally parallel to the longitudinal axis of the landing assembly.

The teeth of the drive part may each comprise a radially outwardly pointing ridge which extends generally parallel to the longitudinal axis of the landing assembly along a distance which is at least as long as the travel distance of the tubing hanger.

The drive part may alternatively or additionally comprise a plurality of radially outwardly pointing teeth, and the orientation engagement assembly may alternatively or additionally comprise an orientation engagement part having a plurality of radially inwardly pointing teeth which are configured to mesh with the teeth of the drive part, the teeth of the orientation engagement part each comprising a radially inwardly pointing ridge which extends generally parallel to the longitudinal axis of the main passage of the wellhead assembly.

The teeth of the orientation engagement part may each comprise a radially inwardly pointing ridge which extends generally parallel to the longitudinal axis of the main passage of the wellhead assembly along a distance which is at least as long as the travel distance of the tubing hanger.

The system may further comprise a landing string, the landing assembly being mounted on an end of the landing string.

A second aspect of the present invention provides a method of operating a wellhead system according to the first aspect, the method comprising the steps of:

a) mounting the landing assembly on an end of a landing string;
b) lowering the landing assembly into the wellhead assembly;
c) operating the actuating system to move the orientation engagement assembly into its engaged configuration with the interior surface of the wellhead assembly; and
d) operating the motor to rotate the tubing hanger to a desired orientation relative to the wellhead assembly.

Step b) may comprise lowering the landing assembly into the wellhead assembly to land the tubing hanger on a landing surface provided on the interior surface of the wellhead assembly.

The wellhead system may further comprise a soft landing device which is operable to allow a downward movement of the tubing hanger in the wellhead through a travel distance after initial engagement of the tubing hanger with a landing surface provided on the wellhead from an initial landing position to a final position, step b) may comprise lowering the landing assembly into the wellhead assembly to land the tubing hanger in the initial landing position on a landing surface provided on the interior surface of the wellhead assembly, and the method may further include, after carrying out step d), lowering the landing assembly further into the wellhead so that the tubing hanger moves from its initial landing position to its final landing position.

The orientation engagement assembly may be retained in its engaged configuration while the tubing hanger is lowered from its initial landing position to its final landing position.

These and other characteristics will become clear from the following description of illustrative embodiments, given as non-restrictive examples, with reference to the attached drawings.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the present invention. The terms are used for the reader's convenience only and shall not be limiting.

FIG. 1 shows a wellhead system 10 comprising a generally tubular wellhead assembly 12 with a main passage 14 and having a longitudinal axis A. The wellhead assembly 12 is configured to be secured to the top of a subsea wellbore 16. The wellhead assembly 12 comprises a wellhead 18 which is mounted on top of the wellbore at the seabed 20, and a blowout preventer (BOP) stack 22 which is mounted on top of the wellhead 18 via a connector/spool 24.

The wellhead system 10 further comprises a landing assembly 26 which is mounted on the end of a landing string 28. The landing assembly 26 comprises a tubing hanger 30 which is secured to a tubing hanger running tool 32. The landing assembly 26 further comprises an orientation control assembly 34 which, in this embodiment, is connected to the tubing hanger running tool 32 via a spacer sub 36. The spacer sub 36 in this embodiment is connected to the tubing hanger running tool 32 and to the orientation control assembly 34 via threaded tool joints provided at each end of the spacer sub 36.

A riser 38 extends vertically upwards from the top of the BOP stack 22 to the ocean surface.

The landing assembly 26 is configured to be lowered down the riser 38 on the landing string 28 into the main passage 14 of the wellhead assembly 12 to land the tubing hanger 30 in the wellhead 18. Tubing 40 is suspended from the tubing hanger 30 and extends down into the subsea wellbore 16.

Figure 2:
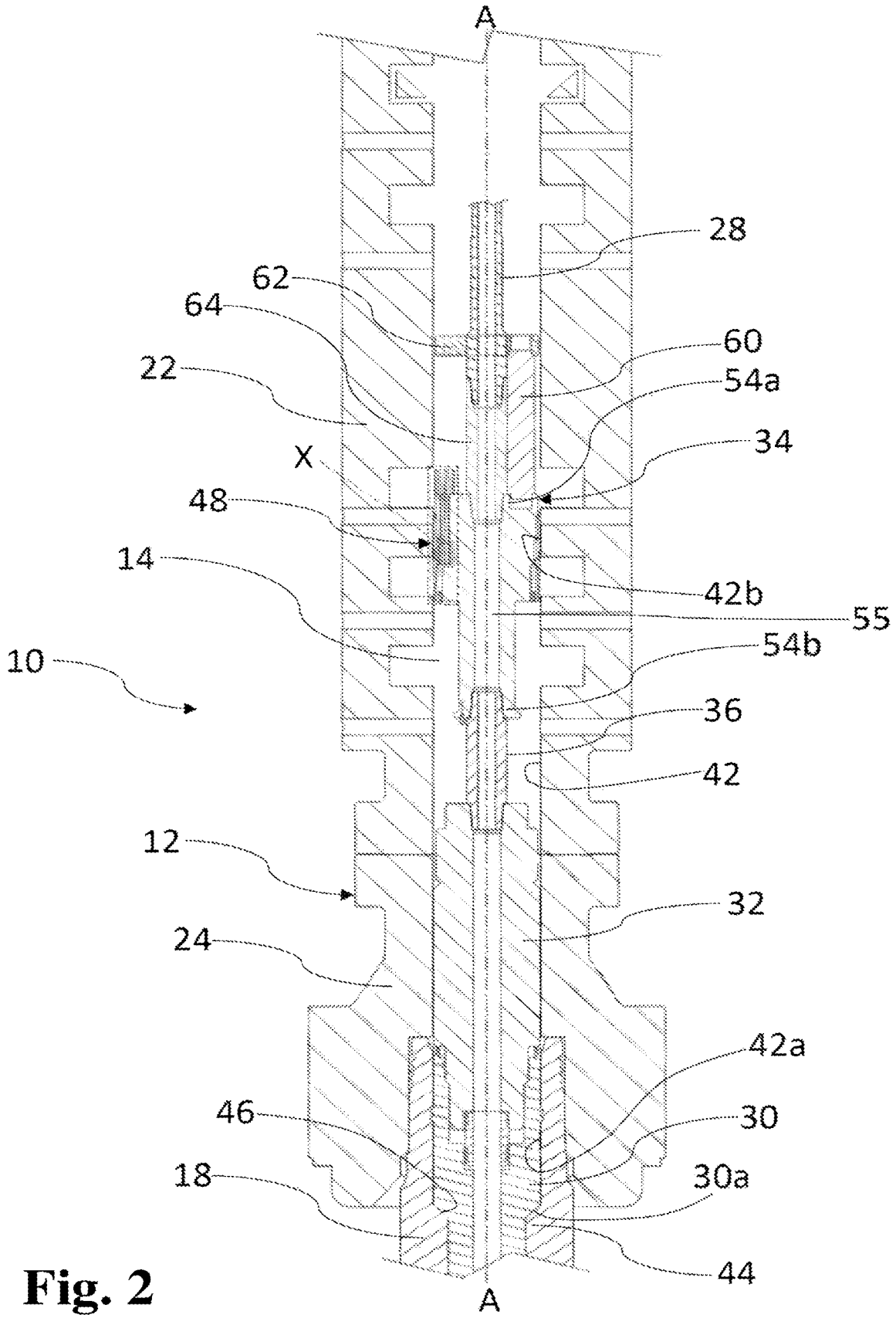
FIG. 2 is an illustration of a longitudinal cross-section through a first embodiment of wellhead system according to the present invention.

The wellhead system 10 is shown in more detail in FIG. 2. The wellhead assembly 12 has an interior surface 42 which encloses the main passage 14. The BOP stack 22, the connector/spool 24, and the wellhead 18 each provide a portion of the interior surface 42. There is a landing shoulder 44 in the interior surface 42*a* of the wellhead 18, the uppermost surface 46 of which is configured to engage with a corresponding landing surface 30*a* provided on the lowermost end of the tubing hanger 30 to support the tubing hanger 30 in the wellhead 18.

The landing assembly 26 also has a longitudinal axis, and in this embodiment, the longitudinal axis of the landing assembly 26 is coaxial with the longitudinal axis A of the wellhead assembly 12 when the tubing hanger 30 is landed on the landing shoulder 44.

The orientation control assembly 34 of the landing assembly 26 comprises an orientation engagement assembly 48, and an actuator system 49 (which will be described in more detail below) which is configured to move the orientation engagement between a retracted configuration and an engaged configuration in which it engages with the interior surface 42 of the wellhead assembly 12. It further comprises a motor 50 and a drive part 52 which is configured to engage with the orientation engagement assembly 48 and, when driven by the motor 50, to rotate the landing assembly 26 about its longitudinal axis A. The motor 50 may comprise a hydraulic or electric motor.

The drive part 52 is connected to the motor 50 so that operation of the motor 50 rotates the drive part 52. Specifically, in this embodiment, operation of the motor 50 rotates the drive part 52 about an axis of rotation which is parallel to the longitudinal axis A of the landing assembly 26.

Figure 3:
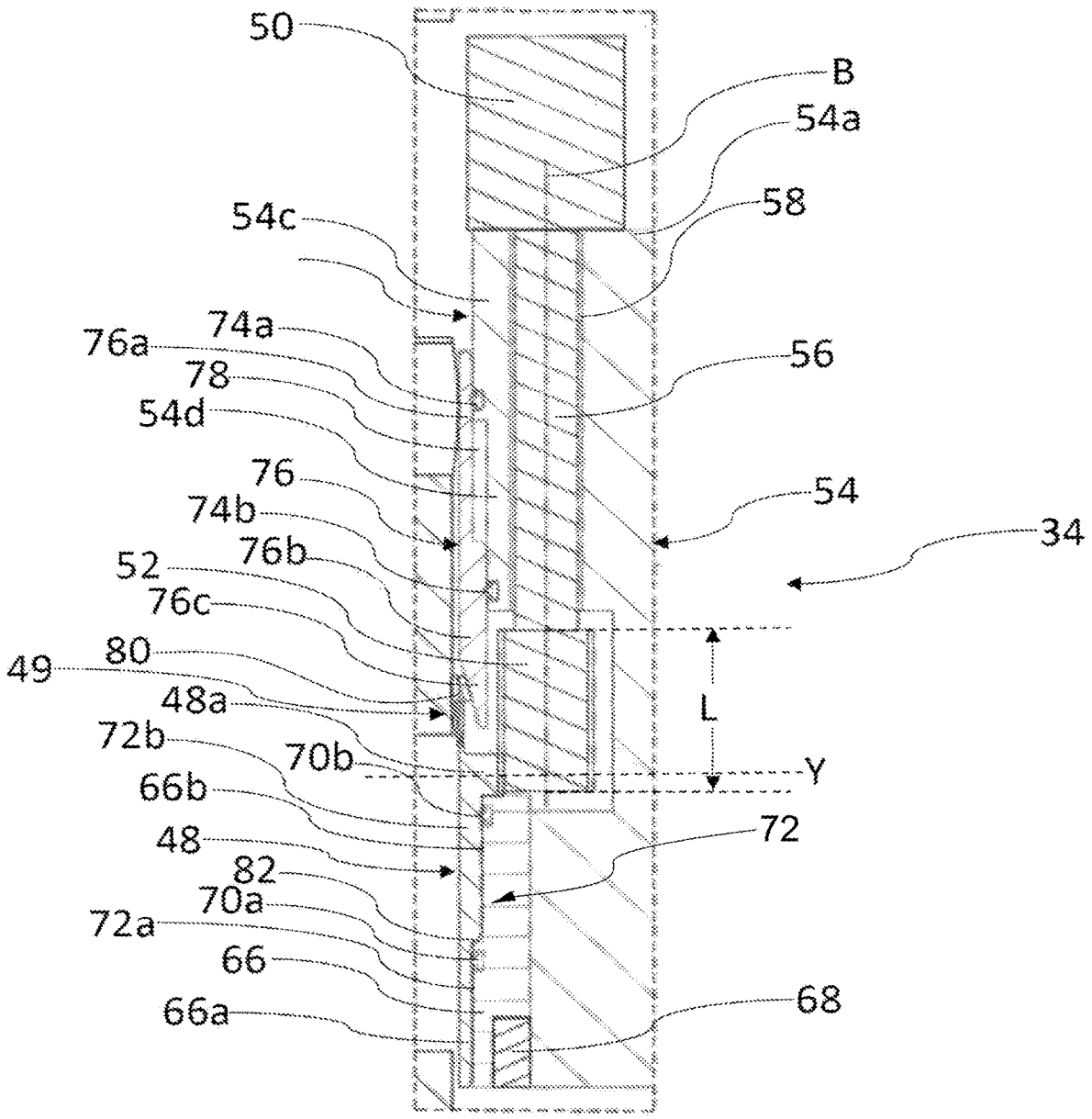
FIG. 3 is an enlarged illustration of the portion enclosed in dashed lines and labelled X in FIG. 2.
Figure 4:
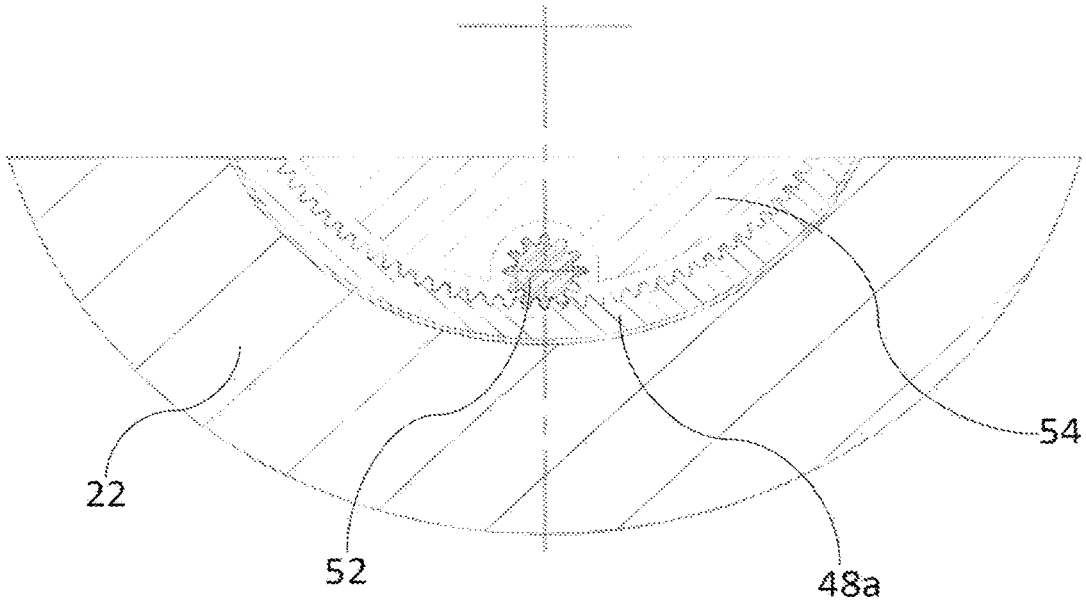
FIG. 4 is an illustration of a transverse cross-section through the drive part and orientation engagement assembly of the wellhead system along the line Y shown in FIG. 3.

The orientation control assembly 34 is shown in more detail in FIGS. 3 and 4.

The orientation control assembly 34 has a tubular body 54 on which the motor 50 is mounted. The body 54 encloses a central passage 55 which, when the tubing hanger 30 is landed in the wellhead 18, is coaxial with the longitudinal axis A of the wellhead assembly.

The motor 50 is mounted on a first end 54*a* of the body 54, and an opposite second end 54*b* of the body 54 is provided with a threaded tool joint to which the spacer sub 36 is secured. The motor 50 is connected to the drive part 52 via a drive shaft 56 which has a longitudinal axis B and which extends along a drive shaft passage 58 provided in the body 54. The drive shaft passage 58 is generally parallel to the central passage 55 so that the longitudinal axis B of the drive shaft 56 extends parallel to the longitudinal axis A of the wellhead assembly 12. The drive part 52 is mounted in a recess in the body 54 and is accessible to the orientation engagement assembly 48 via an opening/window to the radially outwardly facing surface of the body 54. The motor 50 is operable to rotate the drive shaft 56 and the drive part 52 about the axis B. The motor 50/drive shaft 56 and drive part 52 are advantageously configured so that there can be no rotation of the drive part 52 unless the motor is operational. In other words, the drive part 52 can only rotate when driven by the motor 50.

The drive part 52 comprises a plurality of radially outwardly pointing teeth, and the orientation engagement assembly 48 comprises an orientation engagement part 48*a* which has a plurality radially inwardly pointing teeth which mesh with the teeth of the drive part 52. Specifically, in this embodiment, the drive part 52 comprises a pinion gear, and the orientation engagement part 48*a* comprises an annular gear which extends around the entire circumference of the body 54. These are best seen in FIG. 4.

In order to provide support for the orientation engagement assembly 48 around the entire circumference of the body 54, a plurality of idler pinion gears are advantageously arranged around the body 54. The idler pinion gears, like the drive part 52, are provided with a plurality of teeth which mesh with the teeth of the orientation engagement assembly 48. Unlike the drive part 52, these idler gears are not driven and are merely pivotally mounted in passages provided in the body 54 for rotation about an axis which is parallel to the longitudinal axis B of the drive shaft 56.

The landing assembly 26 further comprises an orientation sensor assembly 60 which is configured to measure the orientation of the landing assembly. Any form of sensor which can measure the orientation of an object relative to true north, or relative to a feature within the wellhead assembly 12, can thereby be used.

In this embodiment, one end of the orientation sensor assembly 60 is mounted on the first end 54*a* of the body 54, the other end of the orientation sensor assembly 60 being secured to the landing string 28 via a support clamp 62 which is clamped to the landing string 28 so that movement of that end of the orientation sensor assembly 60 relative to the landing string 28 is prevented. In this embodiment, the landing string 28 is secured to the first end 54*a* of the body 54 via a second spacer sub 64 which is connected to the first end 54*a* of the body 54 and to the landing string 28 via threaded tool joints provided at either end of the second spacer sub 64. The orientation sensor assembly 60 therefore extends alongside the second spacer sub 64. The orientation sensor assembly 60 engages with a locating feature, such as a pocket or recess provided in the body 54, so that the precise position of the orientation sensor assembly 60 relative to the body 54 is fixed and known.

The wellhead system 10 further comprises a controller 63 which is connected to the motor 50, configured to control the operation of the motor 50, and which is connected to the orientation sensor assembly 60 and configured to receive a signal from the orientation sensor assembly 60 indicative of the orientation of the landing assembly 26. The controller 63 may be conveniently located at a topside location, and connected to the motor 50/orientation sensor assembly 60 via a conventional wired or wireless connection.

In this embodiment, the orientation control assembly 34 comprises a seal carrier 66 which is mounted around the body 54 of the orientation control assembly 34 between the drive part 52 and the second end 54*b* thereof. The seal carrier 66 is secured to the body 54 via a threaded retainer ring 68. The seal carrier 66 has a stepped radially outward facing surface with a first portion 66*a* and a second portion 66*b*, the first portion 66*a* having a larger diameter than the second portion 66*b*. A ring seal 70*a*, 70*b* is mounted in a groove provided in each of the first portion 66*a* and second portion 66*b* of the radially outwardly facing surface of the seal carrier 66.

In this embodiment, the orientation engagement assembly 48 comprises a support sleeve 72 which acts to retain the orientation engagement assembly 48 on the body 54. The support sleeve 72 has a correspondingly stepped radially inwardly facing surface having a first portion 72*a* and a second portion 72*b*, the first portion 72*a* having a greater internal diameter than the second portion 72*b*. The orientation engagement part 48*a* is mounted at the uppermost end of the support sleeve 72, and the support sleeve 72 extends from the orientation engagement part 48*a* around the seal carrier 66 towards the second end 54*b* of the body 54. The first ring seal 70*a* engages with first portion 72*a* of the support sleeve 72, and the second ring seal 70*b* engages with the second portion 72*b* of the support sleeve 72. A seal chamber 82 is formed between the steps in the radially outwardly facing surface of the seal carrier 66 and the radially inwardly facing surface of the support sleeve 72 and is enclosed by the ring seals 70*a*, 70*b*. The volume of the seal chamber 82 can be changed by sliding the support sleeve 72 along the seal carrier 66 parallel to the longitudinal axis B of the drive shaft 56. Engagement of the step between the first portion 72*a* and the second portion 72*b* of the support sleeve 72 and the step between the first portion 66*a* and the second portion 66*b* of the seal carrier 66 limits this movement of the support sleeve 72, and the volume of the seal chamber 82 is minimized when the two steps are engaged.

The radially outward facing surface of the body 54 between the drive part and the first end 54*a* thereof is stepped and has a first portion 54*c* which is adjacent to the first end 54*a* and a second portion 54*d* which is adjacent the opening/window which provides access to the drive part 52, the first portion 54*c* having a larger diameter than the second portion 54*d*. A ring seal 74*a*, 74*b* is mounted in a groove provided in each of the first portion 54*c* and second portion 54*d* of the radially outwardly facing surface of the body 54.

In this embodiment, the actuator system 49 is fluid pressure operated, i.e., acts to move the orientation engagement assembly 48 from its retracted position to its engaged configuration in response to the supply of pressurized fluid to the actuator system 49. In this example, the actuator system 49 comprises an energizer sleeve 76 which is mounted around the body 54. The energizer sleeve 76 has a stepped radially inward facing surface with a first portion 76*a* and a second portion 76*b*, the first portion 76*a* having a larger diameter than the second portion 76*b*. The first portion 76*a* of the energizer sleeve 76 contacts the first portion 54*c* of the body 54 and is in sealing engagement with the ring seal 74*a* mounted therein, and the second portion 76*b* of the energizer sleeve 76 contacts the second portion 54*d* of the body 54 and is in sealing engagement with the ring seal 74*b* mounted therein. An energizer actuation chamber 78 is formed between the steps in the radially inwardly facing surface of the energizer sleeve 76 and the radially outwardly facing surface of the body 54, enclosed by the ring seals 74*a*, 74*b*. The volume of the seal chamber 82 can be changed by sliding the energizer sleeve 76 along the body 54 parallel to the longitudinal axis B of the drive shaft 56. Engagement of the step between the first portion 76*a* and the second portion 76*b* of the energizer sleeve 76 and the step between the first portion 54*c* and the second portion 54*d* of the body 54 limits this movement of the energizer sleeve 76, and the volume of the energizer actuation chamber 78 is minimized when the two steps are engaged.

The energizer sleeve 76 is tapered at its lowermost end 76*c*, with the radially outwardly facing surface of the energizer sleeve 76 at the tapered lowermost end 76*c* being inclined relative to the longitudinal axis A of the drive shaft 56, in this example, at an angle of around 20°.

The orientation engagement assembly 48 is also provided with a locking part which is movable to engage with the interior surface 42*b* of the BOP stack 22. In this embodiment, the locking part comprises a tapered expandable collet 80 which is connected to the annular gear, at the opposite side of the annular gear to the support sleeve 72. In other words, while the support sleeve 72 extends from the annular gear towards the second end 54*b* of the body 54, the expandable collet 80 extends from the annular gear towards the first end 54*a* of the body 54.

It should be appreciated that, by virtue of the arrangement of stepped surfaces described above, the separation of the energizer sleeve 76 and the support sleeve 72 is greatest when the volumes of the seal chamber 82 and the energizer actuation chamber 78 are both at a minimum. Sliding movement of the energizer sleeve 76 to increase the volume of the energizer actuation chamber 78 moves the lowermost end 76*c* of the energizer sleeve 76 towards the expandable collet 80, and sliding movement of the support sleeve 72 to increase the volume of the seal chamber 82 moves the expandable collet 80 towards the lowermost end 76*c* of the energizer sleeve 76.

The energizer actuation chamber 78 and the seal chamber 82 are both connected to a source of pressurized fluid (in this embodiment, they are both connected to the same source of pressurized fluid). This could be achieved via a fluid flow passage which extends through the body 54 from the top end 54*a* thereof, a first branch extending through the body 54 into the second portion 54*d* adjacent the step, and a second branch extending through the body 54 to the seal carrier 66, and through the second portion 66*b* of the seal carrier 66 adjacent the step. The fluid flow passage could be connected to a top side source of pressurized fluid via a line which extends down the landing string 28.

The wellhead system 10 may be operated to install the tubing hanger 30 in the wellhead 18 by mounting the landing assembly 26 on an end of the landing string 28 and using the landing string 28 to run the landing assembly 26 down the riser 38 and into the wellhead assembly 12. When the tubing hanger 30 lands on the uppermost surface 46 of the landing shoulder 44, the orientation sensor assembly 60 is used to determine the angular orientation of the landing assembly 26 (either its absolute orientation or its orientation relative to the wellhead). This is compared with the desired orientation of the landing assembly 26, and if the landing assembly 26 is not in the desired orientation, the orientation control assembly 34 is operated as follows to rotate the tubing hanger 30 to the desired orientation as follows.

Pressurized fluid is supplied to the energizer actuation chamber 78 and the seal chamber 82, and this moves the energizer sleeve 76 and support sleeve 72 so that the expandable collet 80 is forced into the tapered space between the tapered lowermost end 76*c* of the energizer sleeve 76 and the interior surface 42*b* of the BOP stack 22. The expandable collet 80 thus engages with the tapered radially outwardly facing surface of the lowermost end 76*c* of the energizer sleeve 76. As the supply of pressurized fluid continues, and the volumes of the energizer actuation chamber 78 and seal chamber 82 increase further, the radially outwardly facing tapered surface at the lowermost end 76*c* of the energizer sleeve 76 exerts a radially outward force on the expandable collet 80 which acts to expand the expandable collet 80. The expandable collet 80 initially resists such an expansion. The step in the radially inwardly facing surface of the energizer sleeve 76 is bigger than the stop in the radially outwardly facing surface of the seal carrier 66, so the downwards force acting on the energizer sleeve 76 is greater than the force pushing the support sleeve 72, orientation engagement assembly 48, and expandable collet 80 upwards. As such, instead of expanding the expandable collet 80, a further supply of pressurized fluid causes the volume of the energizer actuation chamber 78 to continue to increase, while the volume of the seal chamber 82 decreases. In other words, the energizer sleeve 76, expandable collet 80, orientation engagement part 48*a*, and support sleeve 72 move together towards the second end 54*b* of the body 54. Eventually, the support sleeve 72, orientation engagement part 48*a*, and expandable collet 80 moves to a lowermost position in which the volume of the seal chamber 82 is at a minimum and the step between the first portion 72*a* and the second portion 72*b* of the support sleeve 72 engages with the step between the first portion 66*a* and the second portion 66*b* of the seal carrier 66.

As the fluid pressure in the energizer actuation chamber 78 continues to rise, eventually it is sufficient for the lowermost end 76*c* of the energizer sleeve 76 to force the expandable collet 80 to expand into engagement with the interior surface 42*b* of the BOP stack 22. The expandable collet 80 grips the interior surface 42*b* of the BOP stack 22, and prevents movement of the orientation engagement assembly 48 relative to the wellhead assembly 12. To enhance this gripping force, the radially outwardly facing surface of the expandable collet 80 may be provided with features such as teeth, ridges, or striations, or may simply have a roughened surface which increase the coefficient of friction between the expandable collet 80 and the interior surface 42*b* of the BOP stack 22.

The motor 50 is then operated to rotate the drive part 52. By virtue of the meshing of the teeth of the drive part 52 with the teeth of the orientation engagement part 48*a*, and the gripping action of the collet 80 on the interior surface 42*b* of the BOP stack 22, rotation of the drive part 52 drives rotation of the landing assembly 26 within the wellhead assembly about the longitudinal axis A of the wellhead assembly. Using the signal from the orientation sensor assembly 60, the motor 50 is operated to rotate the landing assembly 26 until it reaches the desired orientation.

It will be appreciated that this process could be carried out manually, with an operator reviewing the signal from the orientation sensor assembly 60 and controlling the operation of the motor 50 based on that signal. Advantageously, however, the controller 63 is configured to use the signal from the orientation sensor assembly to determine if the orientation of the landing assembly deviates from a desired orientation, and to then automatically operate the motor 50 to rotate the landing assembly 26 about its longitudinal axis to bring the landing assembly 26 to the desired orientation.

Advantageously, the motor 50 is configured to be controllable to rotate the drive shaft 56 in either a clockwise or an anticlockwise direction depending on the direction of the rotation required to bring the landing assembly to the desired orientation in the minimum number of rotation of the drive shaft 56.

The orientation engagement assembly 48 and drive part 52 are configured so that, when the orientation engagement assembly 48 is in its engaged configuration and engaged with the drive part 52, a rotation of the landing assembly 26 relative to the wellhead assembly 12 is prevented in the absence of operation of the motor 50. As such, once the landing assembly 26 is in its desired orientation, the motor 50 is switched off to fix the orientation of the landing assembly 26.

The tubing hanger 30 may be moveable generally parallel to the longitudinal axis A of the main passage through a travel distance between an initial landing position at which it first engages with the uppermost surface 46 of the landing shoulder 44 of the wellhead 18 and a final landing position. This may be achieved by using a soft landing adapter of the sort disclosed, for example, in U.S. Pat. No. 6,581,691. The soft landing adapter is mounted on the lowermost end of the tubing hanger body and provides the landing surface 30*a*. This arrangement is configured so that the landing surface 30*a* is held in the initial landing position, in which it is in an extended position, as the landing assembly 26 is run into the wellhead, and the tubing hanger 30 is landed on the landing shoulder 44 of the wellhead 18 while the landing surface 30*a* is in the initial landing position. After engagement of the landing surface 30*a* with the uppermost surface 46 of the landing shoulder 44, the landing surface 30*a* retracts to the final landing position by the release of hydraulic fluid from a piston and cylinder arrangement, thus lowering the tubing hanger 30 to its final landing position in a controlled manner. Such a soft landing adapter is designed to act as a buffer between the landing shoulder 44 in the wellhead 18 and the tubing hanger 30, and to absorb the impact of the tubing hanger 30 landing in the wellhead, thus avoiding or minimizing damage to the tubing hanger 30 on landing.

While the soft landing adaptor is provided on the tubing hanger 30 in this embodiment, it should be appreciated that this need not be the case. It could instead be provided on the wellhead 18 so that the uppermost surface 46 of the landing shoulder 44 is movable between an initial landing position and a final landing position, the initial landing position being higher than the final landing position.

Figure 5:
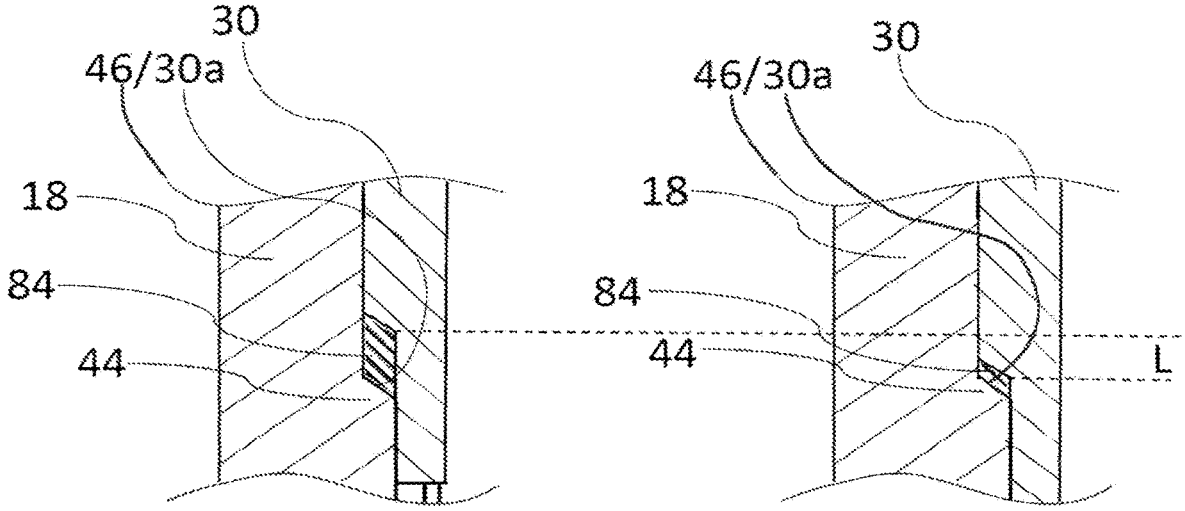
FIG. 5 shows enlarged illustrations of portion of the wellhead and tubing hanger illustrated in FIG. 3 where the system is provided with a soft landing device, whereby (a) shows the tubing hanger in its initial landing position and (b) shows the tubing hanger in its final landing position.

The soft landing adaptor 84 is illustrated schematically in FIG. 5 where (a) shows the tubing hanger 30 in the initial landing position, and (b) shows the tubing hanger in the final landing position.

Where provision for a soft landing of the tubing hanger 30 in the wellhead 18 is provided, the above process for rotation of the tubing hanger 30 into its desired orientation is advantageously carried out when the tubing hanger 30 is in its initial landing position. Once the desired orientation has been achieved, the motor 50 is shut off, and the fluid pressure in the energizer actuation chamber 78 and the seal chamber 82 is maintained so that the orientation engagement part 48*a* remains gripped to the interior surface 42*b* of the BOP stack 22. A downward force is applied to the landing string 28 to move the tubing hanger 30 (and with it, body 54 and seal carrier 66) downwards into the final landing position. The energizer sleeve 76, expandable collet 80, orientation engagement part 48*a*, and support sleeve 72 remain fixed to the interior surface 42*b* of the BOP stack 22, and the downwards movement of the body 54 is accommodated by an increase in the volume of the seal chamber 82 and a decrease in the volume of the energizer actuation chamber 78. The downwards force applied to the landing string 28 must therefore be large enough to overcome the net force of the pressurized fluid resulting from the upwards force exerted on the body 54 by the pressurized fluid in the energizer actuation chamber 78 and the downwards force exerted on the body 54 by the pressurized fluid in the seal chamber 82.

In this embodiment, the drive part 52 has a length L generally parallel to the longitudinal axis B of the drive shaft 56 which is equal to or greater than the travel distance of the tubing hanger 30. The teeth of the drive part 52 comprise a radially outwardly pointing ridge which extends generally parallel to the longitudinal axis B of the drive shaft 56 along the length L of the drive part 52, each pair of adjacent ridges being separated by a corresponding groove. When the tubing hanger 30 is in its initial landing position, the orientation engagement part 48*a* engages with the radially outward facing teeth of the drive part 52 at the lowermost end of the drive part 52. As the teeth (and also the grooves between the teeth) extend parallel to the longitudinal axis A of the wellhead assembly 12, the body 54 can be lowered to lower the tubing hanger 30 to its final landing position with the teeth of the orientation engagement part 48*a* moving along the grooves between the teeth of the drive part 52 until, when the tubing hanger 30 reaches its final landing position, the teeth of the orientation engagement part 48*a* are located between the teeth of the drive part 52 at the uppermost end of the drive part 52.

It will be appreciated that this could equally be achieved by the orientation engagement part 48*a* having a length generally parallel to the longitudinal axis A of the wellhead assembly 12 which is equal to or greater than the travel distance of the tubing hanger 30. In this case, the teeth of the orientation engagement part 48*a* would each comprise a radially inwardly pointing ridge (each pair of adjacent ridges being separated by a groove) which extends generally parallel to the longitudinal axis A of the wellhead assembly 12 along the length of the orientation engagement part 48*a*. The orientation engagement assembly 48 is positioned in the wellhead assembly 12 so that when the tubing hanger 30 is in its initial landing position, the teeth at the uppermost end of the orientation engagement assembly 48 engage with the radially outward facing teeth of the drive part 52. As the teeth (and also the grooves between the teeth) extend parallel to the longitudinal axis A of the wellhead assembly 12, the body 54 can be lowered as the tubing hanger 30 is lowered to its final landing position with the teeth of the drive part 52 moving along the grooves between the teeth of the orientation engagement assembly 48 until, when the tubing hanger 30 reaches its final landing position, the teeth of the drive part 52 are located between the teeth of the orientation engagement assembly 48 at the lowermost end of the orientation engagement assembly 48.

Where the wellhead system 10 is configured to provide a soft landing for the tubing hanger 30. The wellhead system 10 is advantageously operated to use the motor 50 to rotate the landing assembly 26 to its desired orientation when the tubing hanger 30 is in its initial landing position. Once the landing assembly 26 is in its desired orientation, the operation of the motor 50 is stopped, and the lowering of the tubing hanger 30 is continued until it reaches its final landing position. As explained above, the drive part 52 can only rotate when driven by the motor 50, so after the motor 50 is stopped, there can be no rotation of the drive part 52. Also as explained above, the teeth of the drive part 52 remain meshed with the teeth of the orientation engagement part 48*a* while the tubing hanger 30 is lowered from its initial landing position to its final landing position. This provides that the landing assembly 26 cannot rotate from its desired orientation during the movement of the tubing hanger 30 to its final landing position.

Figure 6:
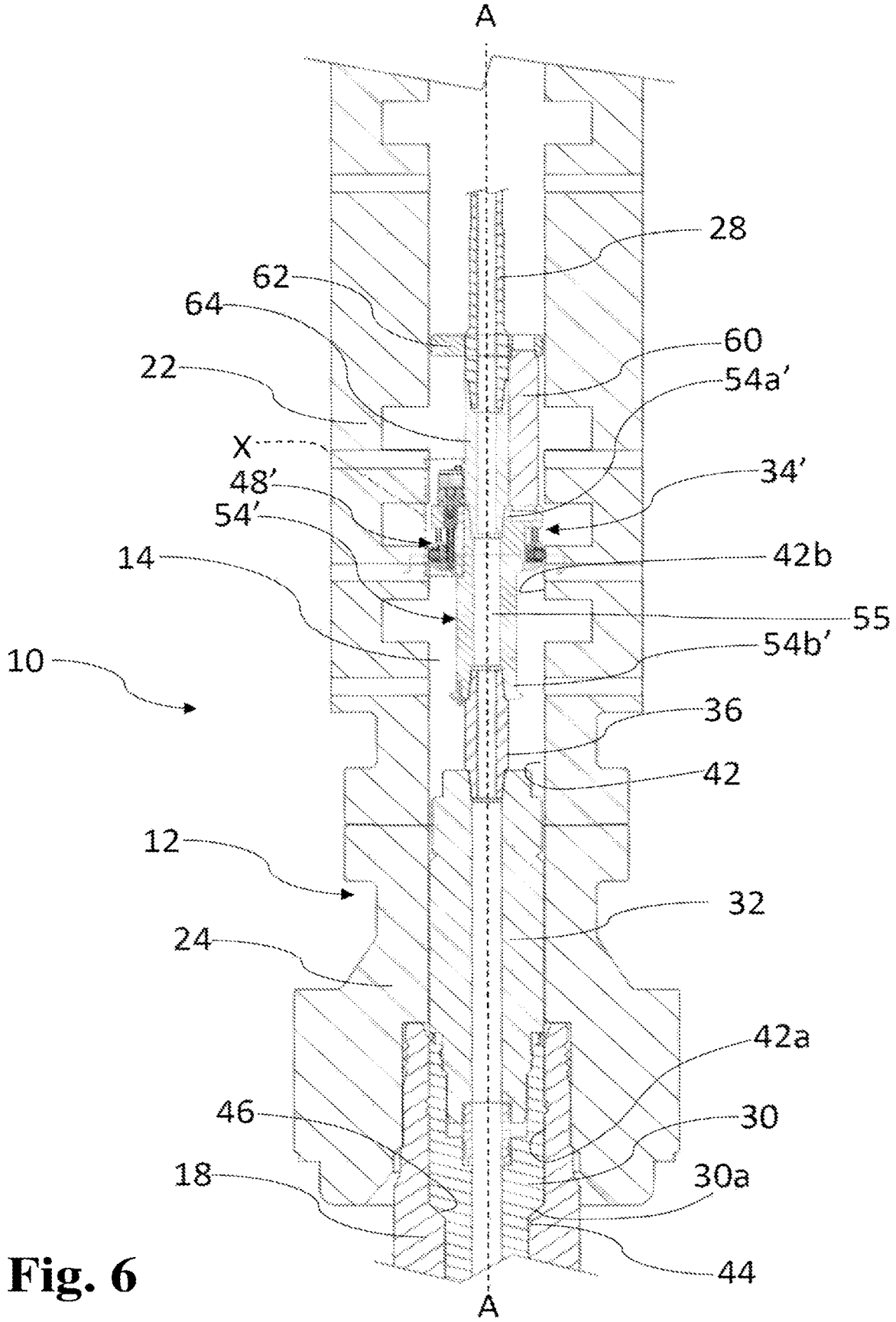
FIG. 6 is an illustration of a longitudinal cross-section through a second embodiment of wellhead system according to the present invention.

An alternative embodiment of orientation control assembly 34' is illustrated in FIGS. 6-9. FIG. 6 shows a wellhead system 10 with a landing assembly 26 incorporating the alternative embodiment of orientation control assembly 34'. The same reference numerals are used as in FIGS. 1-5 to designate the common parts. The description below will focus on the differences between the embodiments, and parts not described below should be assumed to be the same as in the embodiments illustrated in FIGS. 1-5.

Figure 7:
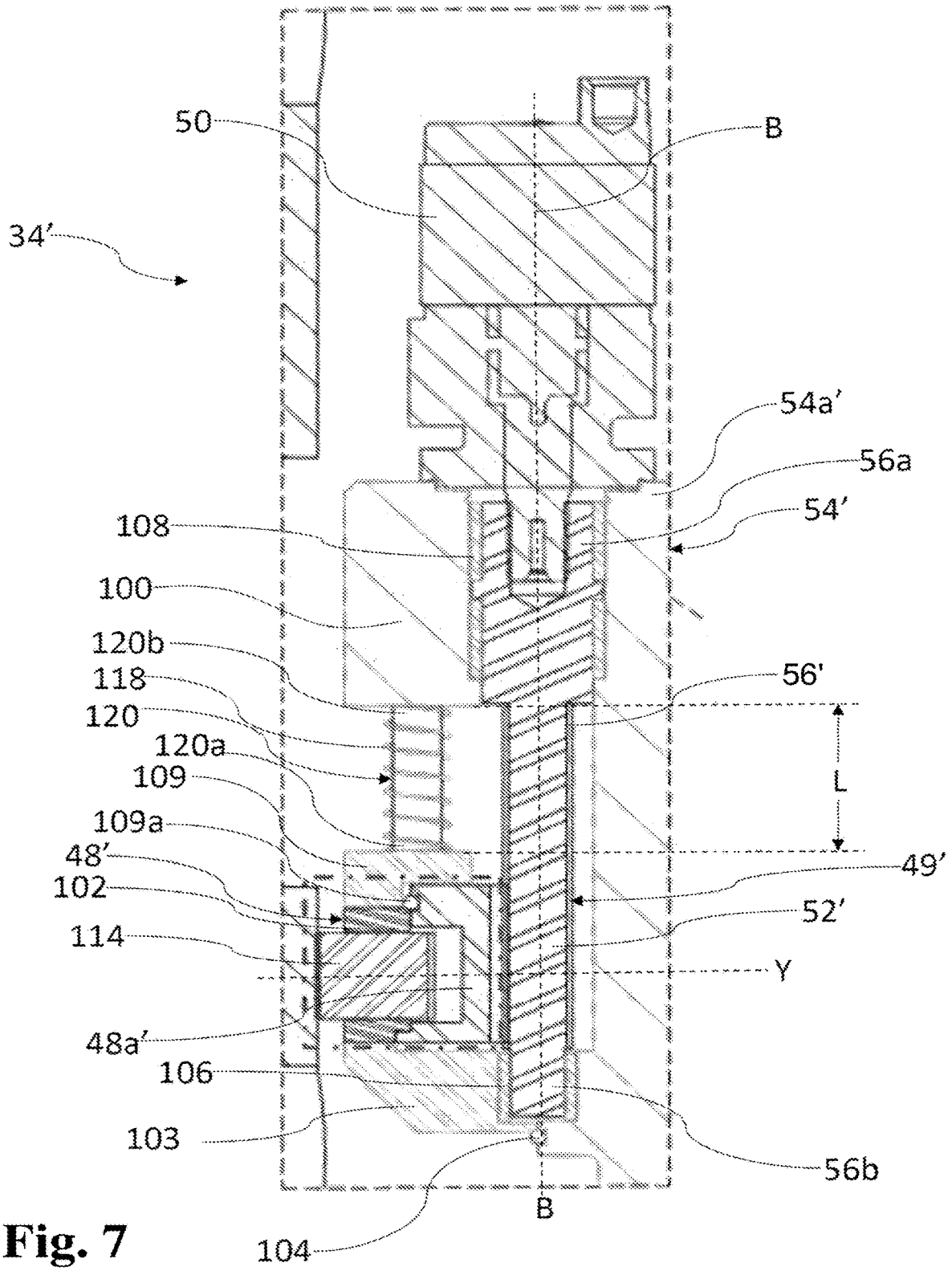
FIG. 7 is an enlarged illustration of the portion enclosed in dashed lines and labelled X in FIG. 6.
Figure 8:
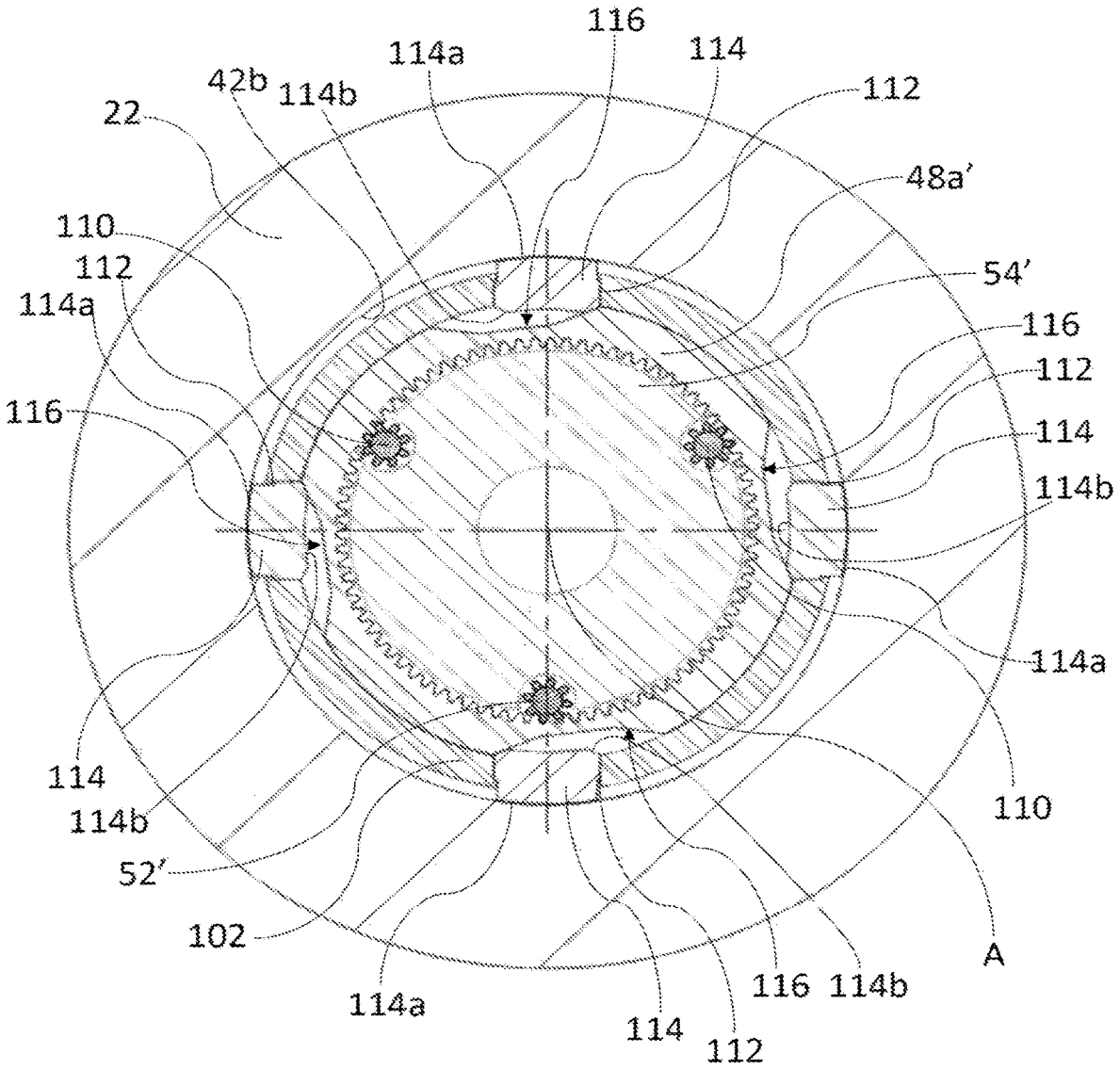
FIG. 8 is an illustration of a transverse cross-section through the wellhead system along the line Y shown in FIG. 7.
Figure 9:
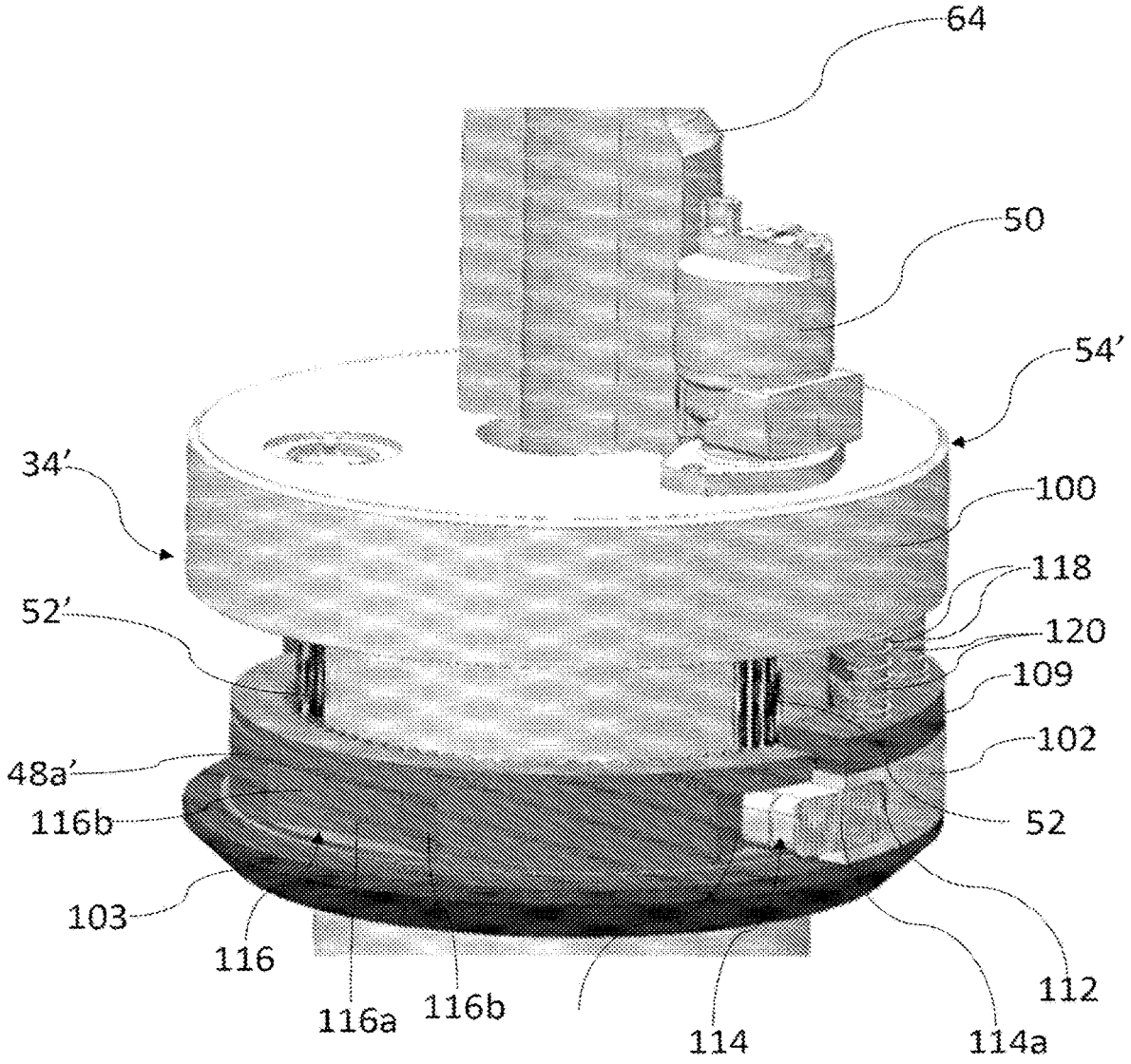
FIG. 9 is a perspective illustration of a portion of the orientation control assembly of the wellhead system illustrated in FIG. 6.

The alternative embodiment of orientation control assembly 34' is illustrated in more detail in FIGS. 7-9. The main differences lie in the configuration of the orientation engagement assembly 48', the body 54', and the actuator system 49'. In particular, rather than being operated by the supply of pressurized fluid, the actuator system 49' is operated by the motor 50. Moreover, rather than using an expandable collet 80, movement of the orientation engagement assembly 48 relative to the BOP stack 22 is prevented by a plurality of locking dogs which are movable radially outwardly to engage with the interior surface 42*b* of the BOP stack 22.

As before, the body 54' of the orientation control assembly 34' has a first end 54*a*' which is secured to the landing string 28 via the second spacer sub 64, and a second end 54*b* which is secured to the tubing hanger running tool 32 via a first spacer sub 36. In this embodiment, however, the body 54' has a radially outwardly extending flange part 100 provided at the first end 54*a*' thereof. The orientation engagement assembly 48' comprises an annular dog cage 102 which is mounted around the body 54 between the flange part 100 and the second end 54*b*' of the body 54', and is supported on the body 54' by an end stop 103 which is secured to the body 54' by a retainer ring 104.

The motor 50 is mounted on an uppermost surface of the flange part 100 and a first end 56*a* of the drive shaft 56 extends from the motor 50 through an aperture provided in the flange part 100 towards the second end 54*b*' of the body 54. A second end portion 56*b* of the drive shaft 56 is lodged in a bearing assembly/bushing 106 which is supported between the end stop 103 and a radially outwardly extending ledge provided on the body 54'. A further bearing assembly/bushing 108 is provided in the aperture in the flange part 100, both bearing assemblies supporting the drive shaft 56 for rotation about its longitudinal axis B when driven by the motor 50.

In this embodiment, the drive part 52' comprises an intermediate portion of the drive shaft 56' which is provided with a plurality of radially outwardly extending teeth, best illustrated in FIG. 8. The orientation engagement assembly 48' again comprises an orientation engagement part 48*a*', which in this embodiment is an annular gear which has a plurality of radially inwardly extending teeth which mesh with the teeth of the drive part 52' as illustrated in FIG. 8. The orientation engagement part 48*a*' is arranged radially inwardly of the dog cage 102, and is captured between the end stop 103 and an annular spring carrier 109. A second retainer ring 109*a* is mounted around the orientation engagement part 48*a*' and engages with the dog cage 102 to secure the dog cage 102 around the orientation engagement part 48*a*', the dog cage 102 being captured between the second retainer ring 109*a* and the end stop 103.

In this embodiment, idler gears 110 are mounted on the body 54' and these also mesh with the teeth of the orientation engagement part 48*a*'. The drive part 52' and idler gears 110 are equally spaced around the circumference of the body 54 to provide that the orientation engagement assembly 48' is fully supported around the body 54'.

The orientation engagement assembly 48' includes a plurality of locking parts which, in this embodiment, are locking dogs 114. The dog cage 102 includes a plurality of windows 112 which are equally spaced around its circumference, and a locking dog 114 is located in each window. Each locking dog 114 has a radially outwardly facing surface 114*a* which may be provided with features such as teeth, ridges, or striations, or may simply have a roughened surface which increase the coefficient of friction between the locking dog 114 and the interior surface 42*b* of the BOP stack 22. Each locking dog 114 also has a radially inward facing surface 114*b* which engages with a radially outwardly facing surface of the orientation engagement assembly 48'. For each locking dog 114, the radially outwardly facing surface of the orientation engagement part 48*a*' has a camming formation 116 which comprises a recess 116*a* which is sufficiently large to contain the portion of the locking dog 114, and which has inclined edge portions 116*b*. These are best illustrated in FIGS. 8 and 9.

The locking dogs 114 can be placed in a retracted configuration in which each is located in a recess 116*a* of the orientation engagement part 48*a*', as illustrated in FIG. 9. The locking dogs 114 are captured in the windows of the dog cage 102 and therefore, if the orientation engagement part 48*a*' is rotated around the body, the locking dogs 114 cannot rotate with the orientation engagement part 48*a*'. The inclined edge portions 116*b* engage with the radially inward facing surfaces 114*b* of the locking dogs 114 to push the locking dogs 114 radially outwardly of the body 54' into their engaged configuration as illustrated in FIG. 8. It will therefore be appreciated that in this embodiment of orientation control assembly 34', the actuator system 49' comprises the motor 50, the drive shaft 56, and the camming formations 116 of the orientation engagement assembly 48'.

This embodiment of orientation control assembly 34' can be operated as follows.

As with the embodiment described above, the landing assembly 26 comprising the orientation control assembly 34' is mounted on an end of the landing string 28 and the landing string 28 is used to run the landing assembly 26 down the riser 38 and into the wellhead assembly 12. During this process, the orientation control assembly 34' is configured so that the locking dogs 114 are in their retracted configuration.

When the tubing hanger 30 lands on the uppermost surface 46 of the landing shoulder 44, the orientation sensor assembly 60 is used to determine the angular orientation of the landing assembly 26 (either its absolute orientation or its orientation relative to the wellhead). This is compared with the desired orientation of the landing assembly 26, and if the landing assembly 26 is not in the desired orientation, the orientation control assembly 34' is operated as follows to rotate the tubing hanger 30 to the desired orientation as follows.

The motor 50 is operated to rotate the drive part 52'. By virtue of the meshing of the teeth of the drive part 52' with the teeth of the orientation engagement part 48*a*', orientation engagement part 48*a*' rotates and the camming formations 116 drive the locking dogs 114 radially outwardly into engagement with the interior surface 42*b* of the BOP stack 22. Once this occurs, the locking dogs 114 block further rotation of the orientation engagement assembly 48' relative to the BOP stack 22, and a further rotation of the drive part 52 drives rotation of the landing assembly 26 within the wellhead assembly 12 about the longitudinal axis A of the wellhead assembly 12. Using the signal from the orientation sensor assembly 60, the motor 50 is operated to rotate the landing assembly 26 until it reaches the desired orientation.

The orientation engagement assembly 48' and drive part 52' are configured so that, when the orientation engagement assembly 48' is in its engaged configuration and engaged with the drive part 52', a rotation of the landing assembly 26 relative to the wellhead assembly 12 is prevented in the absence of operation of the motor 50. As such, once the landing assembly 26 is in its desired orientation, the motor 50 is switched off to fix the orientation of the landing assembly 26.

This embodiment of orientation control assembly 34' can also accommodate the provision for a soft landing of the tubing hanger 30 in the wellhead 18. To facilitate this, the spring carrier 109 is spaced from the flange part 100 by a separation L which is either the same as or greater than the travel distance of the landing surface during the soft landing process, and the teeth of the drive part 52' extend along the entire length of the intermediate portion of the drive shaft 56' from the uppermost surface of the end stop to the lowermost surface of the flange part 100. A plurality of springs 118 extend between the flange part 100 and the spring carrier 109. In this embodiment, the springs 118 are helical compression springs which are each coiled around a guide pin 120. Each guide pin 120 has a first end 120*a* which is secured to the spring carrier 109, and a second end 120*b* which is located adjacent a passage in the flange 100. The springs 118 can therefore be compressed to reduce the space between the spring carrier 109 and the flange part 100, with the second end 120*b* of each guide pin 120 moving into its associated passage. During this process, the body 54', drive shaft 56', and end stop 103 move relative to the orientation engagement assembly 48', dog cage 102, and locking dogs 114, the teeth of the orientation engagement part 48*a*' sliding along the grooves of the drive part 52' towards the first end 56*a* of the drive shaft 56'.

As previously described, the wellhead system 10 is advantageously operated to use the motor 50 to rotate the landing assembly 26 to its desired orientation when the tubing hanger 30 is in its initial landing position. Once the landing assembly 26 is in its desired orientation, the operation of the motor 50 is stopped, and the lowering of the tubing hanger 30 is continued until it reaches its final landing position. During this process, the engagement of the locking dogs 114 with the interior surface 42*b* of the BOP stack 22 provides that the locking dogs 114, the dog cage 102, the orientation engagement part 48*a*', and the spring carrier 109 are fixed relative to the interior surface 42*b* of the BOP stack 22, with the body 54', drive shaft 56', and end stop 103 moving downwards, compressing the springs 118, and reducing the gap between the flange part 100 and the spring carrier 109, the teeth of the orientation engagement part 48*a*' sliding along the grooves of the drive part 52' towards the first end 56*a* of the drive shaft 56' to keep the tubing hanger 30 in the desired orientation.

It will be appreciated that, as discussed above, the surface of the orientation engagement assembly 48, 48' which engages with the interior surface 42 of the wellhead assembly 12 (the radially outwardly facing surface of expandable collet 80 or locking dogs 114) may be provided with features such as teeth, ridges, or striations, or may simply have a roughened surface which increase the coefficient of friction between the orientation engagement assembly 48, 48' and the interior surface 42 of the wellhead assembly 12. Alternatively, or additionally, the relevant portion of the interior surface 42 of the wellhead assembly 12 may be provided with features (which could be integral with or secured to the wellhead assembly 12) which facilitate effective engagement of the orientation engagement assembly 48, 48' with the interior surface 42 of the wellhead assembly 12 and assist in providing that there is rotation of the orientation engagement assembly 48, 48' relative to the interior surface 42 of the wellhead assembly 12 during operation of the motor 50 to rotate the tubing hanger 30.

The present invention is not limited by the embodiments described above; reference should be had to the appended claims.

LIST OF REFERENCE NUMERALS

10 Wellhead system
12 Wellhead assembly
14 Main passage
16 Subsea wellbore
18 Wellhead
20 Seabed
22 Blowout preventer stack/BOP stack
24 Connector/Spool
26 Landing assembly
28 Landing string
30 Tubing hanger
30*a* Landing surface
32 Tubing hanger running tool
34 Orientation control assembly
34' Orientation control assembly
36 Spacer sub/First spacer sub
38 Riser
40 Tubing
42 Interior surface (of wellhead assembly)
42*a* Interior surface (of wellhead)
42*b* Interior surface (of BOP stack)
44 Landing shoulder
46 Uppermost surface (of landing shoulder)
48 Orientation engagement assembly
48' Orientation engagement assembly
48*a* Orientation engagement part
48*a*' Orientation engagement part
49 Actuator system
49' Actuator system
50 Motor
52 Drive part
52' Drive part
54 Body/Tubular body
54' Body/Tubular body
54*a* First end (of body)
54*a*' First end (of body)
54*b* Second end (of body)
54*b*' Second end (of body)
54*c* First portion (of body)
54*d* Second portion (of body)
55 Central passage
56 Drive shaft
56' Drive shaft
56*a* First end (of drive shaft)
56*b* Second end portion (of drive shaft)
58 Drive shaft passage

60 Orientation sensor assembly
62 Support clamp
63 Controller
64 Second spacer sub
66 Seal carrier
66*a* First portion (of seal carrier)
66*b* Second portion (of seal carrier)
68 Threaded retainer ring
70*a* Ring seal
70*b* Ring seal
72 Support sleeve
72*a* First portion (of radially inwardly facing surface of support sleeve)
72*b* Second portion (of radially inwardly facing surface of support sleeve)
74*a* Ring seal
74*b* Ring seal
76 Energizer sleeve
76*a* First portion (of energizer sleeve)
76*b* Second portion (of energizer sleeve)
76*c* Lowermost end (of energizer sleeve)
78 Energizer actuation chamber
80 Expandable collet
82 Seal chamber
84 Soft landing adaptor
100 Flange part
102 Dog cage
103 End stop
104 Retainer ring
106 Bearing assembly/Bushing
108 Bearing assembly/Bushing
109 Spring carrier
109*a* Second retainer ring
110 Idler gear
112 Window
114 Locking dog
114*a* Radially outwardly facing surface (of locking dog)
114*b* Radially inward facing surface (of locking dog)
116 Camming formation
116*a* Recess (of camming formation)
116*b* Inclined edge portion (of camming formation)
118 Spring
120 Guide pin
120*a* First end (of guide pin)
120*b* Second end (of guide pin)
A Longitudinal axis
B Longitudinal axis (of drive shaft)
L Length of drive part

What is claimed is:

1. A wellhead system comprising:

a wellhead assembly which is generally tubular and which is configured to be secured to a top of a borehole, the wellhead assembly comprising a main passage having a longitudinal axis, and an interior surface which encloses the main passage; and a landing assembly comprising a tubing hanger, a longitudinal axis, and an orientation control assembly;

wherein the landing assembly is configured to be lowered into the main passage of the wellhead assembly to land the tubing hanger in the wellhead assembly;

wherein the orientation control assembly comprises:

an orientation engagement assembly comprising a segmented sleeve having a plurality of locking segments arranged circumferentially around the longitudinal axis;

an actuator system which is configured to move the orientation engagement assembly between a retracted configuration and an engaged configuration in which the segmented sleeve engages with the interior surface of the wellhead assembly, wherein the segmented sleeve is driven from the retracted configuration to the engaged configuration via an angled interface between the segmented sleeve and an energizing member, wherein the energizing member is configured to move in a first direction to energize the segmented sleeve along the angled interface and cause at least the plurality of locking segments of the segmented sleeve to expand in a second direction crosswise to the first direction;

a motor; and a drive part which is configured to engage with the orientation engagement assembly and, when the orientation engagement assembly is in the engaged configuration, to be driven by the motor and to rotate the tubing hanger relative to the wellhead assembly about the longitudinal axis of the landing assembly.

2. The wellhead system as recited in claim 1, wherein, when the orientation engagement assembly is in the engaged configuration and is also engaged with the drive part, the orientation engagement assembly and drive part are configured to prevent a rotation of the landing assembly relative to the wellhead assembly in the absence of an operation of the motor.

3. The wellhead system as recited in claim 1, wherein the drive part is connected to the motor so that an operation of the motor rotates the drive part, the drive part comprises a pinion gear having a plurality of radially outwardly pointing teeth, the orientation engagement assembly comprises an orientation engagement part comprising an annular gear having a plurality of radially inwardly pointing teeth configured to mesh with the plurality of radially outwardly pointing teeth of the drive part, the pinion gear is disposed inside of the annular gear, the pinion gear has a first rotational axis radially offset from both the longitudinal axis and a second rotational axis of the annular gear, and the second rotational axis of the annular gear is coaxial with the longitudinal axis.

4. The wellhead system as recited in claim 1, wherein the first direction is an axial direction along the longitudinal axis, and the second direction is a radial direction relative to the longitudinal axis.

5. The wellhead system as recited in claim 4, wherein the segmented sleeve comprises a collet having the plurality of locking segments, the energizing member comprises an energizer sleeve extending at least partially around a circumference of the collet, and the angled interface comprises a first tapered surface of the energizer sleeve configured to engage with a second tapered surface of the collet.

6. The wellhead system as recited in claim 1, wherein the first direction is a rotational direction around the longitudinal axis, and the second direction is a radial direction relative to the longitudinal axis.

7. The wellhead system as recited in claim 6, wherein the segmented sleeve comprises an annular dog cage having the plurality of locking segments disposed in a respective plurality of windows in the annular dog cage, the energizing member comprises an orientation engagement part extending circumferentially around the longitudinal axis inside of the annular dog cage, and the angled interface comprises a plurality of camming surfaces of the orientation engagement part configured to engage with a respective plurality of radially inward facing surfaces of the plurality of locking segments.

8. The wellhead system as recited in claim 1, wherein the actuator system is further configured to be driven by the motor and by the drive part to move the plurality of locking segments, and thereby the segmented sleeve, from the retracted configuration to the engaged configuration;

wherein the drive part rotates the landing assembly about the longitudinal axis of the landing assembly once the plurality of locking segments, and thereby the segmented sleeve, is in the engaged configuration.

9. The wellhead system as recited in claim 1, wherein the actuator system is configured to be moved via a supply of a pressurized fluid to the actuator system to move the plurality of locking segments, and thereby the segmented sleeve, from the retracted configuration to the engaged configuration.

10. The wellhead system as recited in claim 1, wherein the orientation control assembly further comprises an orientation sensor assembly which is configured to measure an orientation of the tubing hanger;

wherein a controller is connected to the motor and to the orientation sensor assembly, the controller being configured to control an operation of the motor and to receive a signal from the orientation sensor assembly which is indicative of the orientation of the tubing hanger.

11. The wellhead system as recited in claim 1, further comprising:

a soft landing device which is operable to allow a downward movement of the tubing hanger in the wellhead assembly through a travel distance after an initial engagement of the tubing hanger with a landing surface provided on the wellhead assembly from an initial landing position to a final landing position.

12. The wellhead system as recited in claim 11, wherein the orientation engagement assembly and the drive part are configured to remain engaged as the tubing hanger moves from the initial landing position to the final landing position.

13. The wellhead system as recited in claim 1, wherein the drive part comprises a first gear having a plurality of radially outwardly pointing teeth each of which comprise a radially outwardly pointing ridge which extends generally parallel to the longitudinal axis of the landing assembly;

wherein the orientation engagement assembly comprises an orientation engagement part which comprises a second gear having a plurality of radially inwardly pointing teeth which are configured to mesh with the plurality of radially outwardly pointing teeth of the drive part, wherein a first number of the plurality of radially outwardly pointing teeth of the first gear is less than a second number of the plurality of radially outwardly pointing teeth of the second gear.

14. The wellhead system as recited in claim 13, further comprising:

a soft landing device which is operable to allow a downward movement of the tubing hanger in the wellhead assembly through a travel distance after an initial engagement of the tubing hanger with a landing surface provided on the wellhead assembly from an initial landing position to a final landing position;

wherein the radially outwardly pointing ridge of each of the plurality of radially outwardly pointing teeth of the drive part which extend generally parallel to the longitudinal axis of the landing assembly further extend along a distance which is at least as long as the travel distance of the tubing hanger so that the orientation engagement assembly and drive part can remain engaged as the tubing hanger moves from the initial landing position to the final landing position.

15. The wellhead system as recited in claim 1, comprising:

a plurality of idler gears;

wherein the drive part comprises a pinion gear, the pinion gear and the plurality of idler gears each have a plurality of radially outwardly pointing teeth, and the pinion gear and the plurality of idler gears are circumferentially spaced apart from one another about the longitudinal axis;

wherein the orientation engagement assembly comprises an orientation engagement part comprising an annular gear having a plurality of radially inwardly pointing teeth which are configured to mesh with the plurality of radially outwardly pointing teeth of the pinion gear and the plurality of idler gears, the teeth of the orientation engagement assembly each comprising a radially inwardly pointing ridge which extends generally parallel to the longitudinal axis of the main passage of the wellhead assembly.

16. The wellhead system as recited in claim 15, further comprising:

a soft landing device which is operable to allow a downward movement of the tubing hanger in the wellhead assembly through a travel distance after an initial engagement of the tubing hanger with a landing surface provided on the wellhead assembly from an initial landing position to a final landing position;

wherein the radially inwardly pointing ridge of each of the plurality of radially inwardly pointing teeth of the orientation engagement part which extend generally parallel to the longitudinal axis of the main passage of the wellhead assembly further extend along a distance which is at least as long as the travel distance of the tubing hanger so that the orientation engagement assembly and drive part can remain engaged as the tubing hanger moves from the initial landing position to the final landing position.

17. A method of operating the wellhead system as recited in claim 1, the method comprising the acts of:

a) mounting the landing assembly on an end of a landing string;

b) lowering the landing assembly into the wellhead assembly;

c) operating the actuator system to move the orientation engagement assembly into the engaged configuration with the interior surface of the wellhead assembly; and d) operating the motor to rotate the tubing hanger to a desired orientation relative to the wellhead assembly.

18. The method as recited in claim 17, wherein act b) further comprises lowering the landing assembly into the wellhead assembly to land the tubing hanger on a landing surface provided on the interior surface of the wellhead assembly.

19. The method as recited in claim 17, wherein the wellhead system further comprises a soft landing device which is operable to allow a downward movement of the tubing hanger in the wellhead assembly through a travel distance after an initial engagement of the tubing hanger with a landing surface provided on the wellhead from an initial landing position to a final landing position;

wherein act b) further comprises lowering the landing assembly into the wellhead assembly to land the tubing hanger in the initial landing position on the landing surface provided on the interior surface of the wellhead assembly;

wherein the method further comprises, after performing act d):

lowering the landing assembly further into the wellhead so that the tubing hanger moves from the initial landing position to the final landing position.

20. The method as recited in claim 19, wherein the orientation engagement assembly is retained in the engaged configuration while the tubing hanger is lowered from the initial landing position to the final landing position.

* * * * *